United States Patent [19]

Light, Jr.

[11] 3,984,987

[45] Oct. 12, 1976

[54] SILT AND POLLUTION CONTROL FOR MARINE FACILITY

[75] Inventor: Stanley C. Light, Jr., Claymont, Del.

[73] Assignee: Sun Shipbuilding and Dry Dock Company, Chester, Pa.

[22] Filed: Dec. 24, 1974

[21] Appl. No.: 536,073

[52] U.S. Cl. ..... 61/1 F; 61/1 R; 61/3

[51] Int. Cl.[2] ..... E02B 15/04; E02B 3/04

[58] Field of Search ..... 61/1 F, 1 R, 2, 5, 3

[56] References Cited

UNITED STATES PATENTS

| | | | |
|---|---|---|---|
| 2,240,567 | 5/1941 | Meacham et al. | 61/1 F |
| 2,391,059 | 12/1945 | MacFarren | 61/1 R X |
| 3,479,824 | 11/1969 | Schaaf et al. | 61/3 |
| 3,592,006 | 7/1971 | Crucet | 61/1 F |
| 3,640,073 | 2/1972 | Samsel | 61/1 F |
| 3,691,773 | 9/1972 | Ruhlman | 61/1 F |
| 3,766,738 | 10/1973 | Gauch | 61/1 F |
| 3,859,796 | 1/1975 | Benson | 61/1 F |

FOREIGN PATENTS OR APPLICATIONS

| | | | |
|---|---|---|---|
| 739,171 | 10/1932 | France | 61/1 F |
| 54,003 | 3/1923 | Sweden | 61/1 F |
| 830,701 | 3/1960 | United Kingdom | 61/1 R |

*Primary Examiner*—Paul R. Gilliam
*Assistant Examiner*—David H. Corbin
*Attorney, Agent, or Firm*—J. Edward Hess; Donald R. Johnson; A. Potts, Jr.

[57] ABSTRACT

Apparatus for a marine facility prevents silt from entering the facility and also provides spill containment. A floating barrier provides the containment and a flexible curtain attached to the barrier and having devices anchoring the curtain to the floor of the water prevents silt from entering the facility. The barrier rises and falls with the tides and openings in the curtain permits the tidal flow to enter and leave the facility. The apparatus is attached to fixed structure in a suitable manner. The barrier and curtain can be moved to permit passage of a ship.

3 Claims, 10 Drawing Figures

SILT AND POLLUTION CONTROL FOR MARINE FACILITY

BACKGROUND OF THE INVENTION

This invention is directed toward prevention of the movement of mud on the bottom of a body of water such as a river. More particularly, this invention is directed toward an apparatus useful for preventing mud or silt from entering the area where a ship is tied to a pier, or some other similar structure. Such an area may be referred to as a wet basin. The apparatus, in addition to preventing the flow of mud or silt, provides for the containment of a pollution spill within the wet basin. One example of a pollution spill is the accidental discharge of fuel oil while the ship is tied to the pier.

Many inventions are directed toward the removal of mud or silt from the wet basin once the foregoing material has entered the wet basin. For example, U.S. Pat. No. 3,486,253 discloses a floating earthmoving apparatus; and U.S. Pat. No. 3,629,963 discloses an apparatus for leveling underwater ground by means of an underwater bulldozer. However, operation of these devices is expensive, time consuming, and cannot be carried out when the ship is tied to the pier. Often the ship is tied to the pier for a considerable time because many major repairs or modifications can be made without having the ship in drydock.

The foregoing problems are overcome by present invention which is a combination silt and pollution spill barrier.

U.S. Pat. No. 3,766,738 discloses a floating boom which forms a barrier on the surface of a liquid. U.S. Pat. No. 3,708,983 discloses a series of air-retaining structural units connected together in a complete loop so that it will float while surrounding a vessel. U.S. Pat. No. 3,613,376 discloses a fence for enclosing impurities floating on water. However, the foregoing patents are silent as to the problem of preventing silt from building up on the bottom of a wet basin.

SUMMARY OF THE INVENTION

The apparatus for preventing silt from entering a marine facility and providing spill containment is constructed of several elements. A floating barrier provides the means whereby liquid spills, e.g., fuel oil, are contained within a confined area, thereby permitting more complete and easier recovery. Connected to the barrier is a flexible curtain having means for anchoring the curtain to the floor of the water body. Thus the curtain prevents silt from entering the area and thereby avoids the necessity of periodic dredging. The curtain also contains at least one opening whereby the tidal flow can enter and leave the facility. The barrier and curtain are connected in such a fashion to a fixed structure, e.g., a pier or dock, so that the barrier and curtain can rise and fall with the tides. Also the barrier and curtain are connected to a fixed structure so that both can be moved to permit the passage of a ship.

DESCRIPTION OF THE INVENTION

Figure 1:
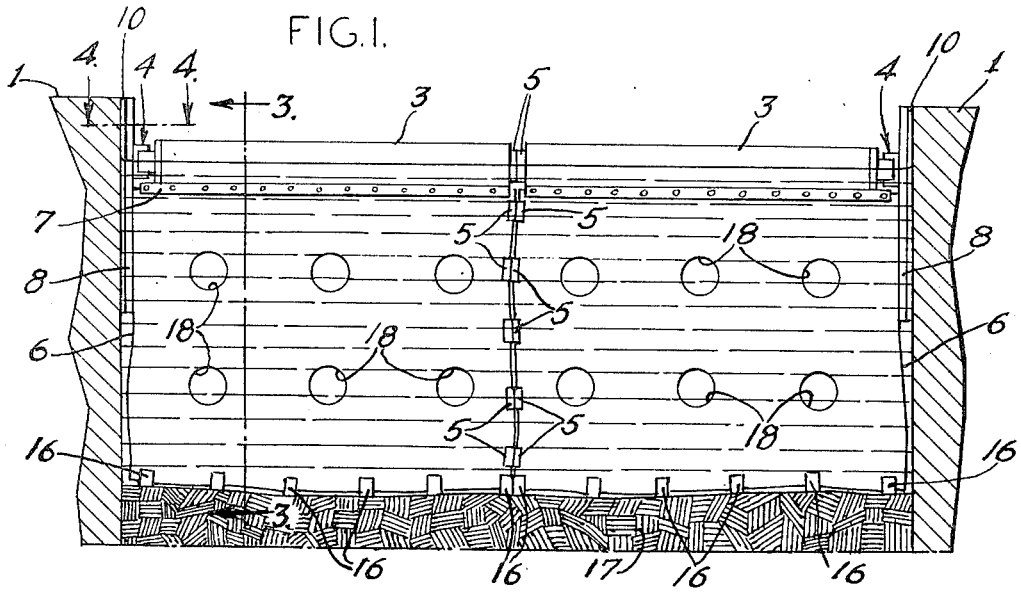
FIG. 1 is a view in elevation and in section showing one embodiment of an apparatus embodying the principle of present invention. The apparatus is in a closed position.

With reference to the drawing, FIG. 1 shows the apparatus of the present invention in a closed position. In such a position silt is prevented from entering the basin and a spill is contained within an area. Generally a fixed structure 1 is on either side of the marine facility. This is more clearly shown in FIG. 9, which is an aerial view of such a facility with a ship 2 located along side one fixed structure 1.

Figure 2:
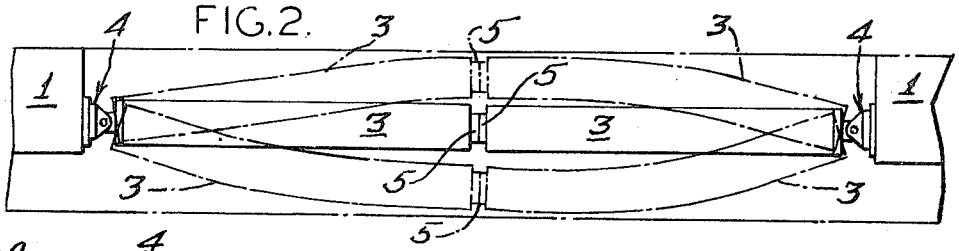
FIG. 2 is a plan view showing one embodiment of present invention with dashes showing how the barrier could bend with movements of the water.
Figure 2A:
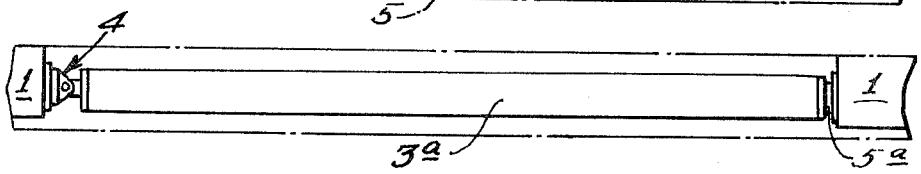
FIG. 2*a* is a plan view showing another embodiment of the present invention wherein the barrier is not in two sections as in FIG. 2 but rather one continuous barrier completely across the facility.

To contain a spill is a floating barrier 3, which in this embodiment is attached via means 4 to the fixed structure 1. While FIG. 1 shows the floating barrier as two equal parts, this is not necessarily a requirement. The barrier may be of different lengths or even only one piece. The latter is shown in FIG. 2*a*. In FIG. 1 the barrier is held together by magnets 5. Other devices are operative. In FIG. 2*a* a barrier 3*a* is held to the fixed structure on the left side by means 4 and on the right side by magnet 5*a*.

Figure 3:
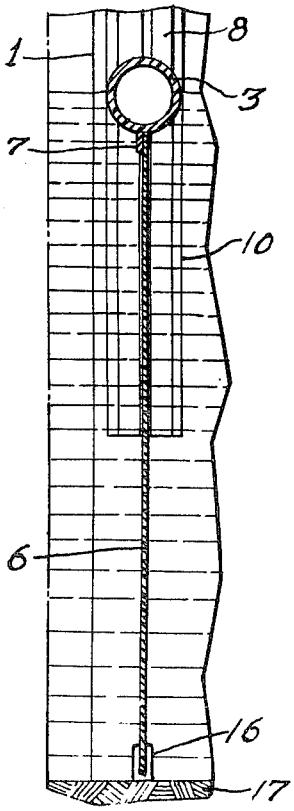
FIG. 3 is a view in section taken along line 3—3 of FIG. 1.
Figure 4:
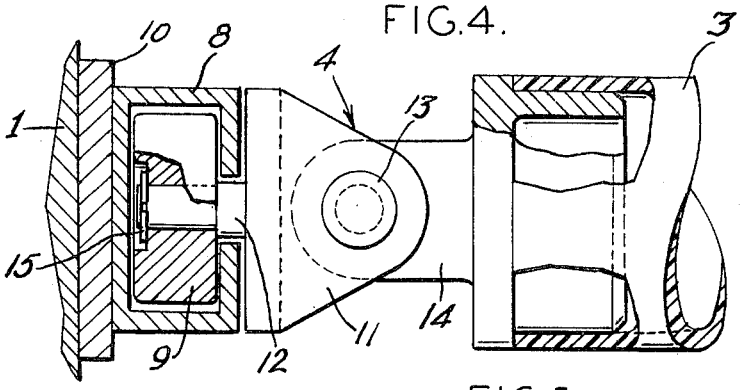
FIG. 4 is a view in section taken along line 4—4 of FIG. 1. It is an enlarged section of the one means for attaching the barrier to a fixed structure. This is a top view in contrast to FIG. 5, which is a side view. The latter is another enlarged section of the means showing how the curtain is attached to the barrier.
Figure 5:
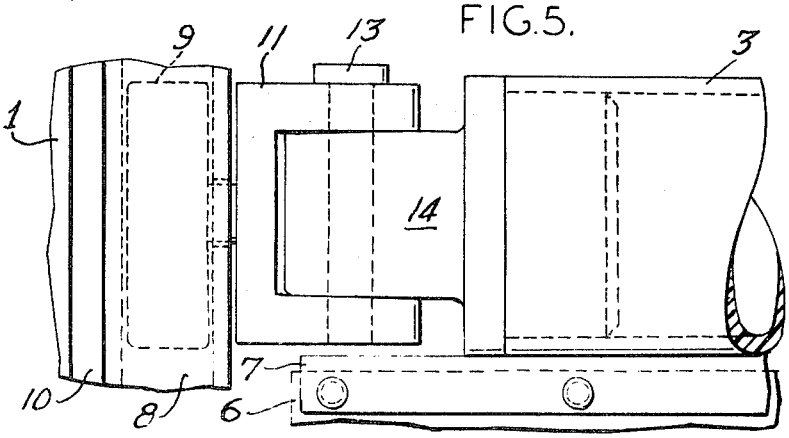

The means 4 of FIG. 1, shown attaching the barrier 3 to the fixed structure 1, is shown in greater detail in FIGS. 3, 4 and 5. FIG. 3 is a view in section taken along line 3—3 of FIG. 1 and shows the track 8 which is attached to the fixed structure 1 via a base plate 10. The latter is shown in FIG. 4; within the track 8 is a structure 9 which can move up and down within the track 8. The structure 9 is connected to a swivel 11 via a neck 12 which can slide up and down with the neck portion of track 8. Swivel 11 permits the barrier 3 to move with water current and wind. Swivel 11 as shown is a typical pin and collar. FIG. 5 shows a side view of the pin 13 and collar 14 of FIG. 4 where it is shown as a top view. In FIG. 4 the structure 9 is held to neck 12 via a split ring.

As shown in FIG. 1 the curtain 6 is attached to the floating barrier 3 via means 7. This attachment is shown in greater detail in FIG. 5. The curtain 6 has openings 18 whereby the tidal flow can enter and leave the facility. The area of the opening 18 or the numbers of openings depends on the particular water movements, and can be calculated by standard engineering techniques. In FIG. 1, the two curtains are shown held together in a closed position by magnets 5. Other devices are operative. However, curtain of FIG. 2 is continuous, that is, it is not in two sections, and is attached to the right fixed structure 1 by magnets 5*a*, but here too other devices are operative. The curtain 6 is anchored to the bottom 17 by various means such as weights 16. Other means include, for example, anchors. The material used to construct the curtain can be any one of numerous synthetic thermoplastics such as polyethylene, polypropylene and polyvinyl chloride, etc., or natural materials such as rubber, treated cotton. The thermoplastics can be reinforced with, for example, fiberglass. Certain thermoset plastics, with or without reinforcements, could also be used.

The barrier can be constructed of natural floating materials such as wood or cork. Alternatively, it could be a closed cellular material such as polyurethane, or an air-retaining structure wherein a synthetic thermoplastic or natural material is used. It could be one continuous structure or consist of several smaller structures suitably hinged together. The object of the barrier is to float on the surface of the water such that it will contain a spill. Another object is to hold the curtain in place.

Figure 6:
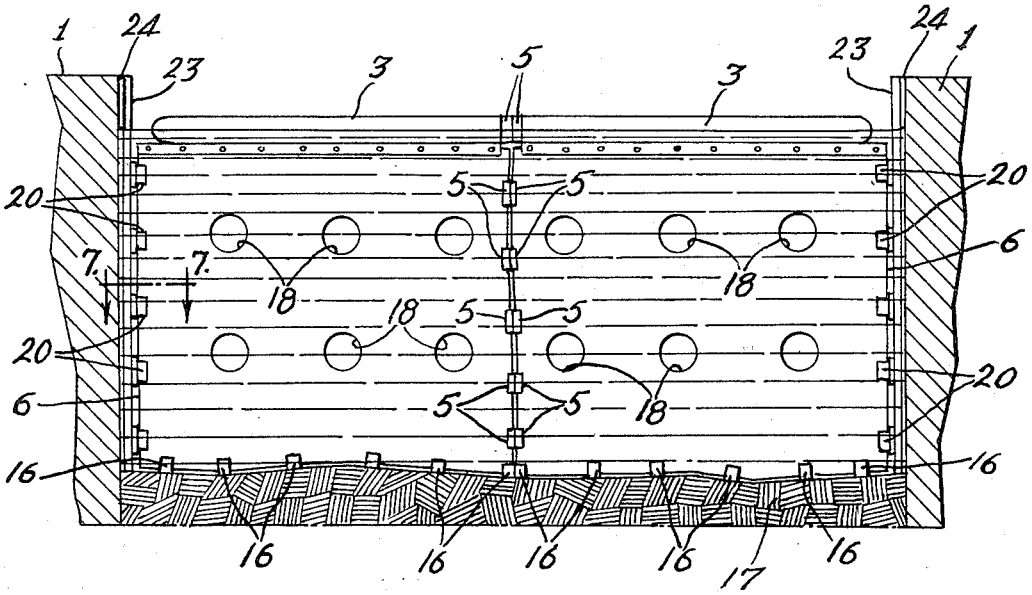
FIG. 6 is a view in elevation and in section showing another embodiment of an apparatus embodying the principle of the present invention. The apparatus is in a closed position. This embodiment is different from FIG. 1 in that the barrier is attached only to the curtain which is attached to a fixed structure, whereas in FIG. 1 only the barrier is attached to a fixed structure.
Figure 7:
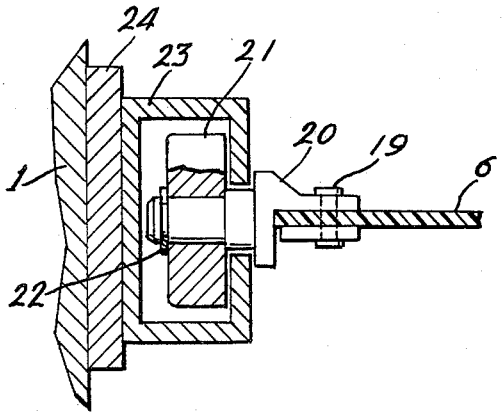
FIG. 7 is a view in section taken along line 7—7 of FIG. 6.
Figure 8:
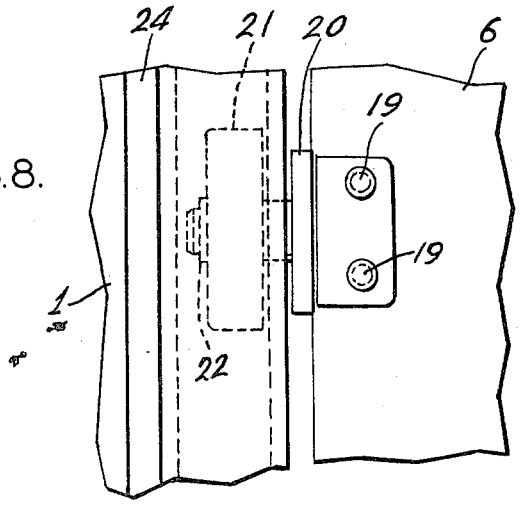
FIG. 8 is an enlarged section of the means for attaching only the curtain to a fixed structure.

FIG. 6 is another embodiment of present invention. In this embodiment the curtain 6 is attached to the fixed structure 1 rather than the barrier 3 as in FIG. 1. FIG. 7 is a view in section taken along line 7—7 of FIG. 6. FIG. 7 shows the details of how the curtain is connected; it can be considered a top view whereas FIG. 8 can be considered a side view. In FIG. 7 the curtain 6 is bolted 19 to an L shape member 20. The latter is attached to a structure 21 via holding device 22. Structure 21 can move up or down within the confines of track 23. The latter is connected to a plate 24 which holds it to fixed structure 1. As shown the curtain 6 contains holes 18 to permit passage of tidal flow. Also magnets 5 hold the two sections together.

Figure 9:
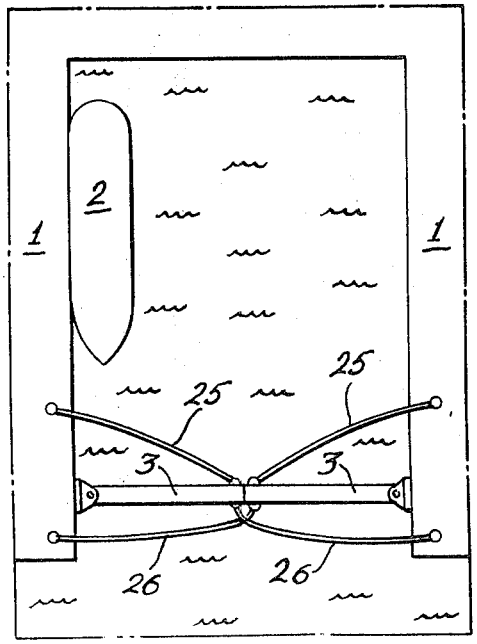
FIG. 9 is a plan view showing one embodiment of an apparatus embodying the principles of the present invention as it appears in position relative to the marine facility containing a ship. Also shown are means for closing and opening the apparatus.

With reference to FIG. 9, ship 2 is shown tied to fixed structure 1, and present invention in place to prevent silt from filling the bottom of the marine facility. After ship 2 is serviced and is about to leave it is necessary to move the barrier 3. In this example, the barrier 3 is opened by a rope 25, attached to one end of the barrier. After the ship 2 has departed, the barriers 3 can be brought together by other ropes 26 attached to the barriers. In a closed position rope 26 could be on the bottom and in a slack state. Other means for opening and closing the barrier are feasible.

In another embodiment of present invention both the barrier and the curtain are attached to the fixed structure by suitable means which permit movement for the passage of a ship and permits the barrier to float.

The invention claimed is:

1. An apparatus for a marine facility for preventing silt from entering the facility and providing spill containment comprising:

a. fixed structure to which a ship can tie up;

b. barrier floating on water and enclosing an area between it and the fixed structure whereby a spill is contained within the area;

c. flexible curtain attached to the barrier and extending downward to floor of a water body and having anchoring means holding the curtain to the floor of the water body whereby silt is prevented from entering the contained area and the curtain having openings within the curtain whereby tidal flow can enter and leave the contained area;

d. vertical and horizontal moving mounting means attaching the barrier to the fixed structure whereby the barrier is permitted to rise and fall with the tide and both the barrier and curtain can be moved vertically or horizontally to permit passage of a ship;

e. moving means for vertically or horizontally moving the barrier to permit passage of a ship and again enclosing the contained area.

2. An apparatus for a marine facility for preventing silt from entering the facility and providing silt containment comprising:

a. fixed structure to which a ship can tie up;

b. barrier floating on water and enclosing an area between it and the fixed structure whereby a spill is contained within the area;

c. flexible curtain attached to the barrier and extending downward to floor of a water body and having anchoring means holding the curtain to the floor of the water body whereby silt is prevented from entering the contained area and the curtain having openings within the curtain whereby tidal flow can enter and leave the contained area;

d. vertical and horizontal moving mounting means attaching the curtain to the fixed structure whereby the barrier is permitted to rise and fall with the tide and both the curtain and barrier can be moved vertically or horizontally to permit passage of a ship;

e. moving means for vertically or horizontally moving the curtain to permit passage of a ship and again enclosing the contained area.

3. An apparatus for a marine facility for preventing silt from entering the facility and providing spill containment comprising:

a. fixed structure to which a ship can tie up;

b. barrier floating on water and enclosing an area between it and the fixed structure whereby a spill is contained within the area;

c. flexible curtain attached to the barrier and extending downward to floor of a water body and having anchoring means holding the curtain to the floor of the water body whereby silt is prevented from entering the contained area and the curtain having openings within the curtain whereby tidal flow can enter and leave the contained area;

d. vertical and horizontal moving mounting means attaching the barrier to the fixed structure whereby the barrier is permitted to rise and fall with the tide and whereby the barrier can be moved vertically or horizontally to permit passage of a ship;

e. vertical and horizontal moving mounting means attaching the curtain to the fixed structure whereby the curtain can be moved vertically or horizontally to permit passage of a ship;

f. moving means for vertically or horizontally moving both the curtain and the barrier to permit passage of a ship and again enclosing the contained area.

* * * * *